United States Patent [19]

Konno

[11] 4,062,328

[45] Dec. 13, 1977

[54] ELECTRICALLY CONTROLLED FUEL INJECTION SYSTEM

[76] Inventor: Mitsutaka Konno, No. 2-12-102, Asahi, Yokohama, Japan

[21] Appl. No.: 609,064

[22] Filed: Aug. 29, 1975

[30] Foreign Application Priority Data

Sept. 5, 1974 Japan ..... 49-102239

[51] Int. Cl.[2] ..... F02B 3/00; F02B 77/00

[52] U.S. Cl. ..... 123/32 EL; 123/198 DB; 180/105 E; 74/866

[58] Field of Search ..... 123/32 EA, 97 B, 198 DB, 123/32 EI; 180/105 R, 105 E, 110; 74/866

[56] References Cited

U.S. PATENT DOCUMENTS

| | | | |
|---|---|---|---|
| 3,486,595 | 12/1969 | Turner | 123/97 B |
| 3,750,631 | 8/1973 | Scholl | 123/32 EA |
| 3,756,208 | 9/1973 | Toda | 123/97 B |
| 3,763,720 | 10/1973 | Aono | 74/866 |
| 3,809,028 | 5/1974 | Luchaco | 123/32 EA |
| 3,821,943 | 7/1974 | Toda | 123/97 B |

*Primary Examiner*—Ronald B. Cox

*Attorney, Agent, or Firm*—Robert E. Burns; Emmanuel J. Lobato; Bruce L. Adams

[57] ABSTRACT

Electrical circuit is provided in a conventional electrically controlled fuel injection control system of an internal combustion engine, which control system has characteristics of ceasing fuel injection during vehicle's free-wheeling. The electrical circuit serves to prevent the cease of fuel injection in response to a neutral position of a transmission shift lever and/or vehicle speed below a predetermined level.

4 Claims, 2 Drawing Figures

ELECTRICALLY CONTROLLED FUEL INJECTION SYSTEM

BACKGROUND OF THE INVENTION

The present invention relates generally to an electrically controlled fuel injection system of an internal combustion engine, and more particularly to an arrangement for use with the system for improving reliability of engine operation.

It is well known to employ an electrically controlled fuel injection system in order to increase engine performance of a vehicle and to reduce harmful exhaust emission etc. The conventional control system usually comprises a computer, an air flow meter, an electrical switch operatively coupled to a throttle, and a distributor. The computer is electrically connected to the air flow meter for deriving therefrom an information indicative of the amount of air flowing through the manifold and also connected to the distributor for sensing the ignition timing. The control system electrically controls, on the basis of the informations thus obtained, the fuel injection timing and also the quantity of fuel to be injected into cylinders of the engine through injection valves provided in respective manifold branches. In the above-mentioned control system, it is of usual practice that the system is designed in such a manner as to cease the fuel injection for an economical purpose and reduction of harmful exhaust emission while the vehicle runs by inertia, i.e., free-wheels, that is, when the engine speed is above a predetermined value (for example, 1300 rpm) and at the same time the degree of opening of the throttle is below a predetermined value (for example, an angle of 3° while idling). In the above, the engine speed is sensed from the distributor by the computer.

In the aforementioned conventional control system, however, there are encountered some difficulties as to the ceasing of the fuel injection. That is, in the case that the control system ceases the fuel injection upon the detection of the engine speed exceeding the predetermined level, when thereafter, the engine speed in turn falls down below the predetermined level, there might be a possibility that the engine stops due to delayed fuel supply resulting from slow response to the change of the engine speed. This possibility is especially considerable in a vehicle equipped with automatic transmission, wherein, it its inertia or free-wheeling run, the engine speed is scarcely affected by the driving wheels. Furthermore, the above-mentioned possibility also tends to occur in the case where a driver accelerates the engine when the vehicle is at rest and immediately thereafter changes the transmission from neutral to a drive range.

To avoid these inherent defects of the prior art, in accordance with the present invention, there are provided two electrical switches which are connected in series with each other. One of these two switches is operatively connected to a transmission shift lever such as to open in response to the neutral position of the shift lever thus breaking a circuit applying information to the computer indicative of the ceasing of fuel injection. On the other hand, the other switch is operatively connected to a vehicle speedometer such as to open in response to the vehicle speed below a predetermined level (for example, 10 kph) to function as the firstly mentioned switch.

SUMMARY OF THE INVENTION

It is therefore an object of the present invention to provide an electrical circuit in a conventional electrically controlled fuel injection control system for improving engine performance.

It is another object of the present invention to provide an electrical circuit in a conventional electrically controlled fuel injection control system of an internal combustion engine, which control system has characteristics of ceasing fuel injection during vehicle's free-wheeling, in order to prevent the cease of fuel injection in response to a neutral position of a transmission shift lever and/or vehicle speed below a predetermined level.

BRIEF DESCRIPTION OF THE DRAWING

These and other objects, features and many of the attendant advantages of this invention will be appreciated more readily as the invention becomes better understood by the following detailed description, when considered in connection with the accompanying drawings, and wherein.

DESCRIPTION OF THE PREFERRED EMBODIMENT

Figure 1:
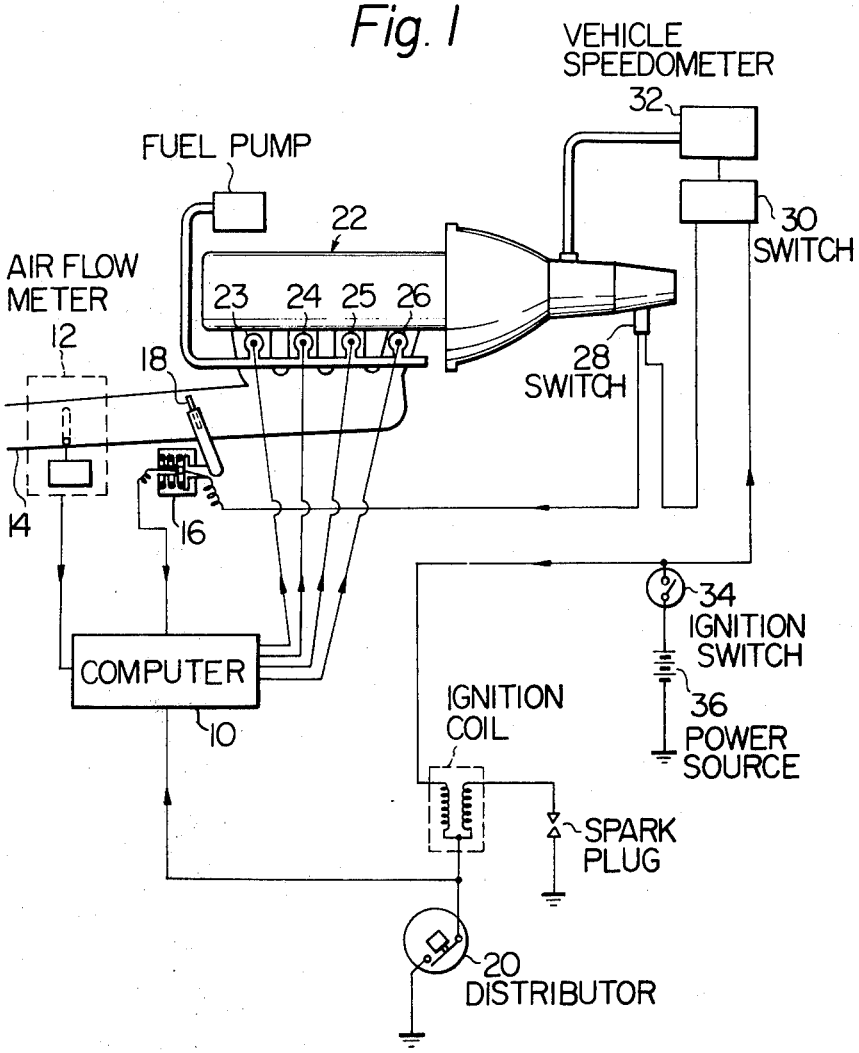
FIG. 1 shows, in a block diagram, an improved arrangement embodying the present invention together with the conventional electrically controlled fuel injection control system.

Reference is now made to FIG. 1, wherein an arrangement embodying the present invention is schematically depicted together with an electrically controlled fuel injection control system of a conventional type. The control system comprises a computer 10, an air flow meter 12 of a conventional type, an electrical switch 16 operatively coupled to a throttle 18, and a distributor 20. The computer 10, as shown, is electrically connected to the air flow meter 12 for deriving therefrom information indicative of the amount of air flowing through the manifold 14 and is also connected to the distributor 20 for sensing the ignition timing. The control system, as is well known in the art, electrically controls, on the basis of the information thus obtained, the fuel injection timing and also the quantity of fuel to be injected into cylinders (not shown) of an engine 22 through injection valves 23, 24, 25, 26 provided in respective manifold branches (no numerals). In the present specification, details of the circuit arrangement and functions of its computer 10 will be omitted in that these have been disclosed in the U.S. Pat. No. 3,620,196.

It is of usual practice that the above-mentioned control system is designed in such a manner as to cease fuel injection for an economical purpose and reduction of harmful exhaust emission while the vehicle runs by inertia, or free wheels, that is, when the engine speed is above a predetermined value (or example, 1300 rpm) and at the same time the degree of opening of the throttle 18 is below a predetermined value (for example, an angle of 3°). In the above, the engine speed is sensed from the distributor 20 electrically connected to the computer 10.

However, there are encountered some difficulties in the conventional control system with respect to the ceasing of the fuel injection. That is, in the case that the control system ceases the fuel injection upon the detection of the engine speed exceeding the predetermined level (for example, 1300 rpm), when, thereafter, the engine speed in turn falls down below the predetermined level, there might be a possibility that the engine stops due to delayed fuel supply resulting from slow response to the change of the engine speed. This possibility is especially considerable in a vehicle equipped with automatic transmission wherein, in its inertia or free-wheeling run, the engine speed is scarcely affected by the driving wheels. Furthermore, the above-mentioned possibility also tends to occur in the case where a driver accelerates the engine when the vehicle is at rest and immediately thereafter changes the transmission from neutral to a drive range.

To avoid these inherent defects of the prior art, in accordance with the present invention, there are provided an electrical switch 28 and another electrical switch 30, which are connected in series with each other as seen in the present embodiment of FIG. 1. The switch 28 is operatively connected to a transmission shift lever (not shown) such as to open in response to the neutral position thereof thus breaking a series circuit consisting of a d.c. power source 36, ignition switch 34, the switch 30, the other switch 28, and the switch 16. This means that the switch 28 serves to prevent the ceasing of the fuel injection which otherwise might occur in the conventional control system. On the other hand, the switch 30 is operatively connected to a vehicle speedometer 32 such as to open in response to the vehicle speed below the predetermined level (for example, 10 kph) thereby to function as the switch 28. In the present embodiment, two switches 28 and 30 are employed, however, it is apparent that either of them can be omitted in accordance with the requirement of the system.

Figure 2:
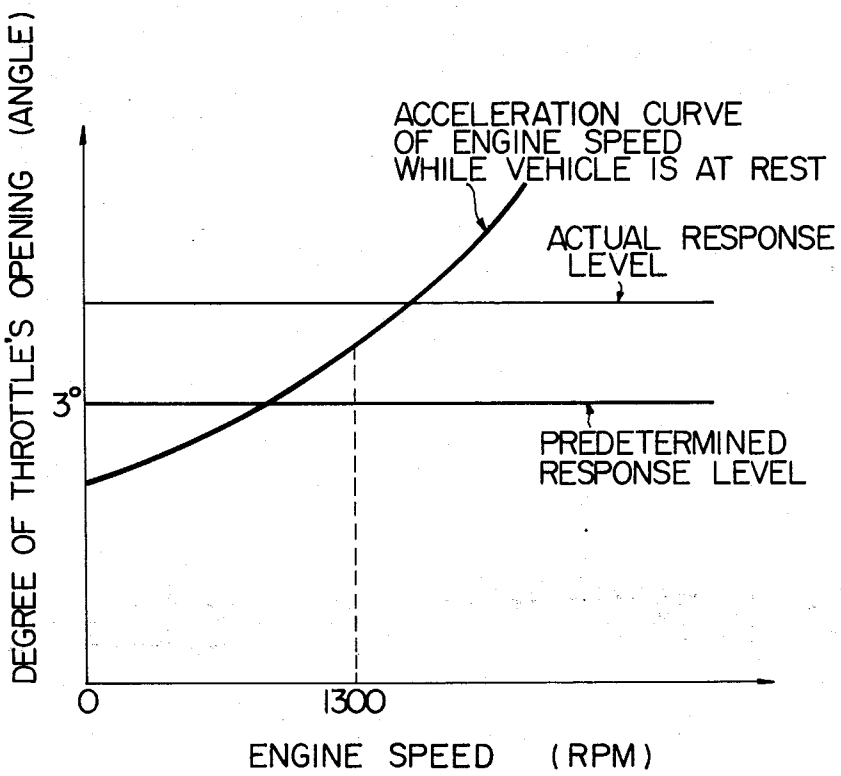
FIG. 2 is a graph illustrating an area of the cease of fuel injection.

Another advantage according to the present invention is that the switch 16, when employed in the present embodiment, does not require high accuracy or frequent adjustment as in the conventional control system. The switch 16 is usually a mechanical device so that, in the conventional control system, frequent maintenance is required to ensure reliable operation of the system. This is because an actual response degree of opening of the throttle 18 tends to deviate from the predetermined value. Assuming that the central response degree of opening of the throttle 18 increases as shown in FIG. 2, the ceasing of fuel injection, in the conventional control system, unwantedly occurs. Therefore, according to the conventional control system, when a driver accelerates the engine while the vehicle is at rest, undesirable hunting phenomena is liable to occur due to the ceasing of the fuel injection. Furthermore, the above-mentioned undesired occurrence is invited owing to the same reason when the vehicle is started. However, according to the present invention, these defects can be easily obviated by the provision of the switches 28 and/or 30.

From the foregoing, it is understood that the arrangement in accordance with the present invention makes the conventional electrically controlled fuel injection control system more reliable, economical, and suitable for reduction of air pollution.

What is claimed is:

1. An arrangement for use with an electrically controlled fuel injection system for an internal combustion engine of a vehicle, the system comprising an air-flow meter operatively attached to an intake manifold for sensing the amount of air flowing therethrough and an electrical switch attached to a throttle for sensing the degree of the throttle opening and a computer, the computer electrically controlling the quantity of fuel injected into cylinders of the engine and also fuel injection timing in accordance with the amount of the air and the engine speed derived from a distributor, the system ceasing the injecting of fuel when the engine speed is above a predetermined value and at the same time the degree of the opening of the throttle is below a predetermined value, wherein the improvement comprises, means electrically connected to the system for preventing the ceasing of fuel injection when the vehicle speed falls below a predetermined level.

2. In an arrangement for use with an electrically controlled fuel injection system for an internal combustion engine of a vehicle, the system comprising:

an intake manifold;

a throttle;

a distributor;

an air-flow meter cooperative with the intake manifold for sensing the amount of air flowing therethrough;

a first electrical switch attached to the throttle for sensing the degree of the throttle opening; and a computer electrically connected to the air-flow meter, the distributor and the first electrical switch for controlling the quantity of fuel injected into cylinders of the engine and fuel injection time in accordance with the amount of the air and engine speed derived from the distributor, the computer ceasing injection of fuel when the engine speed is above a predetermined value and at the same time the degree of the opening of the throttle is below a predetermined value, the improvement which comprises:

a second and a third electrical switch connected in use in series with each other and interposed electrically between the first electrical switch and a d.c. power source and having means respectively responsive to a neutral position of a transmission shift lever and to the vehicle speed below a predetermined level for preventing the cessation of fuel injection.

3. In an arrangement as claimed in claim 2, wherein the second electrical switch comprises means for operatively connecting it to the vehicle transmission shift lever to open it when the transmission shift lever is in a neutral position.

4. In an arrangement as claimed in claim 2, wherein the third electrical switch comprises means for operatively connecting it to a speedometer of the vehicle to open when the vehicle speed falls below the predetermined level.

* * * * *